US005680083A

United States Patent [19]

Kogawa et al.

[11] Patent Number: 5,680,083

[45] Date of Patent: Oct. 21, 1997

[54] ELECTROMAGNET DEVICE FOR ELECTRO-MAGNETIC CONTACTOR

[75] Inventors: Kuniyuki Kogawa; Toru Tsuchiya; Mitsuo Ishihara, all of Saitama, Japan

[73] Assignee: Fuji Electric Co., Ltd., Kawasaki, Japan

[21] Appl. No.: 539,351

[22] Filed: Oct. 5, 1995

[30] Foreign Application Priority Data

Oct. 25, 1994 [JP] Japan ..... 6-258609
Jun. 6, 1995 [JP] Japan ..... 7-139022

[51] Int. Cl.[6] ..... H01H 67/02

[52] U.S. Cl. ..... 335/132; 335/202

[58] Field of Search ..... 335/132, 202

[56] References Cited

U.S. PATENT DOCUMENTS 4,893,102 1/1990 Bauer ..... 335/132
4,951,018 8/1990 Schmiedel et al. ..... 335/132

*Primary Examiner*—Lincoln Donovan
*Attorney, Agent, or Firm*—Kanesaka & Takeuchi

[57] ABSTRACT

An electromagnet device for an electromagnetic contactor is formed of a frame with an opening, a movable-contact supporter slidably disposed in the frame, a movable contact supported by the movable-contact supporter, a movable core connected to the movable-contact supporter, and a stationary core for attracting the movable core. The stationary core includes a base plate for closing the opening of the frame, at least one columnar arm core fixed to the base plate to extend therefrom, and at least one pole piece fixed to the arm core at a side opposite to the base plate. The pole piece provides attracting force to the movable core when the stationary core is energized. In the electromagnetic device, a device for partly interrupting a magnetic path of the stationary core is formed. The interrupting device reduces remanent flux in the stationary core when the stationary core is deenergized.

9 Claims, 3 Drawing Sheets

ELECTROMAGNET DEVICE FOR ELECTRO-MAGNETIC CONTACTOR

BACKGROUND OF THE INVENTION AND RELATED ART STATEMENT

The present invention relates to an electromagnet device for an electromagnetic contactor which uses an electromagnet for operating a movable contact.

Specifically, the present invention relates to an electromagnet device for an electromagnetic contactor which is formed of a movable contact supported with a movable-contact supporter; a movable core connected to the movable-contact supporter; a stationary core for attracting the movable core; and a base plate closing a lower end opening of a frame in which the cores are contained. The stationary core includes an columnar arm core fixed on the base plate to stand up therefrom, and a pole piece for providing attractive force to the movable core. The pole piece is fixed on the arm core at a side opposite to the base plate.

An example of a conventional bridge type electromagnetic contactor provided with this sort of an electromagnet device, which has been widely used, is shown in FIG. 5. In this example, an electromagnetic contactor comprises a switching contact 1 and an electromagnet device 2. The switching contact 1 is disposed on the upper side of an upper case 3. Two C-shaped stationary contacts 4, each having a stationary-contact tip 4*a* at one end and a terminal screw 4*b* on the other end, are attached to the upper case 3 such that the stationary-contact tips 4*a* are positioned inside. Between the stationary contacts 4, a movable-contact supporter 5 is disposed slidably in a vertical direction, and connected by a pin 7 to a movable core 6 of the electromagnet device 2, which is retained in a frame formed of the upper case 3 and a lower case 13. A movable contact 8 has two movable-contact tips 8*a*, which allow to bridge between the stationary-contact tips 4*a* disposed on the stationary contacts 4, and is attached through a contact spring 9 to the movable-contact supporter 5.

The switching contact 1, which comprises the stationary contacts 4 and the movable contact 8, is covered with an arc quenching cover 10. The electromagnet device 2, which is contained in the frame formed of the upper case 3 and the lower case 13, comprises a ferromagnetic base plate 16, arm cores 15 into which coils 11 are fitted and which are fixed to the base plate 16, and pole pieces 14 fixed to the end of the arm cores 15 on the side facing the movable core 6. The movable-contact supporter 5 slides vertically as the movable core 6 is attracted to and released from the pole pieces 14.

In this structure, the movable-contact supporter 5 pulls the movable-contact tips 8*a* from the stationary-contact tips 4*a* to open the electromagnetic contactor by interrupting excitation of the coils 11 and by releasing the movable core 6 from the pole pieces 14 by the force of a return spring 12. When the coils 11 are energized again, the pole pieces 14 attract the movable core 6, so that the movable-contact tips 8*a* contact the stationary-contact tips 4*a* to close the electromagnetic contactor.

In the electromagnet device as shown in FIG. 5, however, even if the excitation of the coils 11 is interrupted, attractive force remains due to a remanent flux in the cores, and the movable core 6 may not be released from the pole pieces 14 even by the force of the return spring 12. Therefore, as shown in FIG. 5, a non-magnetic plate 24, such as a stainless steel plate, is usually fixed to the pole face 6*a* of the movable core 6 facing the pole pieces 14 by brazing or by resistance welding so as to solve the aforementioned problem.

When the non-magnetic plate is disposed on the pole face of the movable core, however, the non-magnetic plate on the pole face of the movable core collides with the pole pieces at the end of closing operation of the electromagnetic contactor, so that the non-magnetic plate may be deformed or damaged by repetition of the collision. The deformation or damage is more liable to occur as compared with the usual switching devices, since the non-magnetic plate is used while heat is generated by very frequent collisions in a high temperature environment caused by heat from the coils and generated by very frequent switching operation of the electromagnetic contactor in the frame or housing closed for dust-proof.

Therefore, a thicker non-magnetic plate should be used to minimize the deformation and damage. But the thickness of the non-magnetic plate naturally has a limit and the allowable thickness thereof is less than about 0.5 mm for securing necessary attracting force, since a thick non-magnetic plate expands a gap between the pole pieces and the pole face of the movable core due to a small attracting stroke of the movable core. Therefore, brazing or resistance welding is used for fixing the non-magnetic plate on the pole face of the movable core, as described above. These fixing methods, however, have a problem of cost increase of the electromagnetic contactor since silver in the brazing solder is very expensive, and a furnace is needed for jointing, so that the jointing work is time-consuming.

Therefore, it is an object of the present invention is to provide a structure of an electromagnet device which facilitates to reduce the remanent flux at a low cost without fixing a non-magnetic plate on a pole face of a moving core.

SUMMARY OF THE INVENTION

According to an aspect of the invention, there is provided an electromagnet device for an electromagnetic contactor which comprises a movable contact supported by a movable-contact supporter; a movable core connected to the movable-contact supporter; a stationary core for attracting the movable core; a base plate for closing a lower end opening of a frame in which the cores are contained; and means for interrupting a magnetic path in the stationary core. The stationary core includes columnar arm cores standing up from and fixed on the base plate, and pole pieces for exerting an attracting force to the movable core. The pole pieces are fixed to the ends of the arm cores at the opposite side of the base plate.

It is preferable to form the base plate of a ferromagnetic substance, and to locate the interrupting means between the arm cores and the base plate and/or between the arm cores and the pole pieces.

It is also preferable to form the stationary core by using the base plate made of a non-magnetic substance and by inserting a ferromagnetic plate between the arm cores and the base plate. The interrupting means may be located between the arm cores and the pole pieces, between the arm cores and the ferromagnetic plate and/or in the ferromagnetic plate.

It is also preferable to form the interrupting means as a coated layer or a plated layer of a non-magnetic substance.

Furthermore, in the stationary core formed of the non-magnetic base plate and the ferromagnetic plate inserted between the base plate and the arm cores, the means for interrupting the magnetic path in the ferromagnetic plate may be a gap or space.

As described above, in the electromagnet device having the means for interrupting the magnetic path in the stationary core, a remanent flux, which remains in the cores after stopping supply of electricity to the coils, can be reduced. By this structure, it is unnecessary to join the non-magnetic plate on the pole face of the movable core, so that the movable core can directly collide with the pole pieces when the movable core is attracted. The movable core and the pole pieces are usually made of hard structural steel specified by Japan Industrial Standard (JIS) according to economical consideration. Since the distance between the movable core and pole pieces is not widened even if the pole pieces are made thicker, necessary attracting force is obtained, and the pole pieces can be made thick enough to prevent themselves from deformation or damage by the collisions.

When a ferromagnetic base plate is used for constituting the stationary core, the means for interrupting the magnetic path is located between the arm cores and the pole pieces and/or between the arm cores and the base plate. Alternatively, when a non-magnetic base plate is used and a ferromagnetic plate is inserted between the arm cores and the base plate so as to constitute the stationary core, the interrupting means is located between the arm cores and the pole pieces, between the arm cores and the ferromagnetic plate and/or in the ferromagnetic plate. In these cases, since the interrupting means is located at the end of the respective constituent members of the stationary core, the interrupting means can be disposed without further processing the constituent members.

Furthermore, when the coating layer or the plating layer of the non-magnetic substance is used for the magnetic path interruption in each location described above, the coating layer or the plating layer can be formed on the surface of the constituent members of the stationary core so as to interrupt the magnetic path at a low cost.

Moreover, when the non-magnetic base plate is used and the ferromagnetic plate is inserted between the arm cores and the base plate so as to constitute the stationary core, the interrupting means may be a gap which divides the ferromagnetic plate at the position located away from the arm cores, so that the magnetic path interruption can be conducted at a further lower cost without coating or plating on the structural members.

DETAILED DESCRIPTION OF PREFERRED EMBODIMENTS

Figure 1:
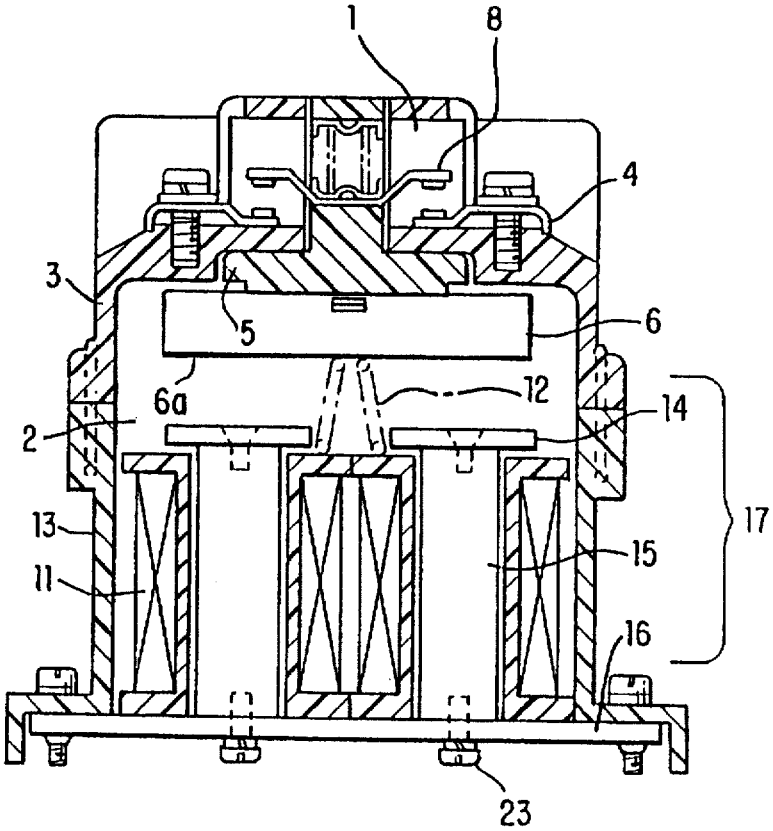
FIG. 1 is a sectional view showing the whole structure of an electromagnet device of a first embodiment of the present invention.
Figure 2:
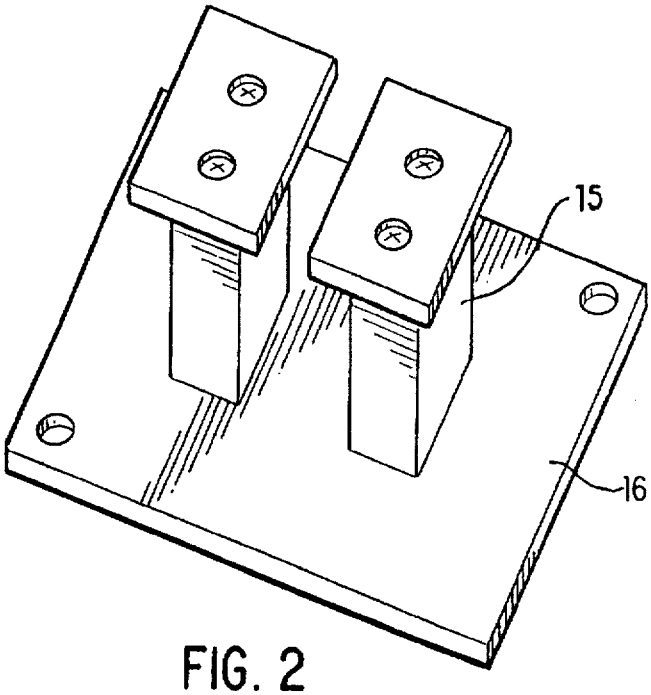
FIG. 2 is a perspective view showing a main structure of a stationary core shown in FIG. 1.

FIG. 1 is a sectional view showing the whole structure of an electromagnet device of a first embodiment of the present invention, and FIG. 2 shows a perspective view of a stationary core shown in FIG. 1. In these figures, constituents corresponding to those in FIG. 5 are designated by the same reference numerals, and their explanations are omitted hereinafter.

Figure 5:
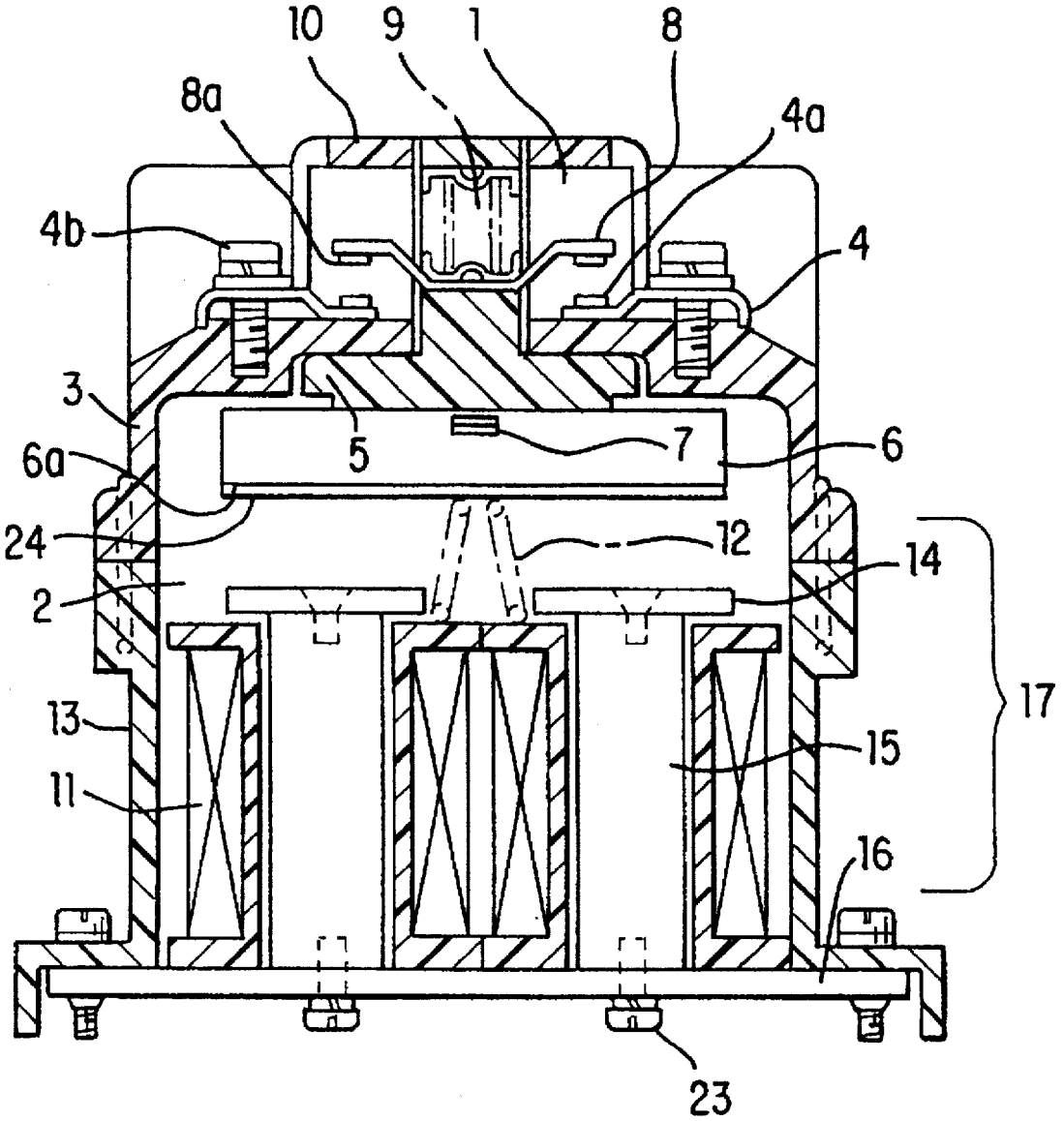
FIG. 5 PRIOR ART
FIG. 5 is a sectional view showing the whole structure of an electromagnet device of the prior art.

In these figures, a stationary core 17 is formed of pole pieces 14, arm cores 15, and a base plate 16 made of structural steel according to JIS, and has essentially the same structure as in the prior art device shown in FIG. 5. However, at least one of the pole pieces 14, the arm cores 15, and the base plate 16 is plated with non-magnetic substance, e.g. Cu, Zn, etc., or coated with resin etc. Thus, a non-magnetic layer exists on a contacting surface of at least one of these members, and interrupts a magnetic path in the stationary core to form a magnetic gap without using the conventional non-magnetic plate such as a stainless steel plate. By adjusting the thickness of the coating layer or the plating layer corresponding to the members to be processed, necessary remanent flux reduction can be obtained at a low cost.

For example, when the coating is applied only to the arm cores, means for interrupting the magnetic path are located at two positions, i.e. both ends of the arm cores. On the base plate side, since a large amount of the total flux caused by the energized coils of the electromagnet flows through the periphery of the arm cores, the processed layer on the base plate side slightly obstructs the flow of the total flux, so that the thickness of the layer does not largely effect the attracting force. On the pole piece side, however, since the area of each pole piece is small, nearly the total flux flows through the processed layer at the pole piece side. Consequently, the processed layer should be made thin so as to keep the necessary attracting force. However, since the remanent flux after de-energizing the coils is small, the total flux flows through the both end faces of the base plate side and the pole piece side of the arm core. Thus, the reduction of the remanent flux can be performed on both sides of the arm cores and made effectively without making the processed layer thick. Since the thin processed layer requires short plating time for the plated layer and small number of coating times for the resin coating layer, the processing cost is reduced.

Figure 3:
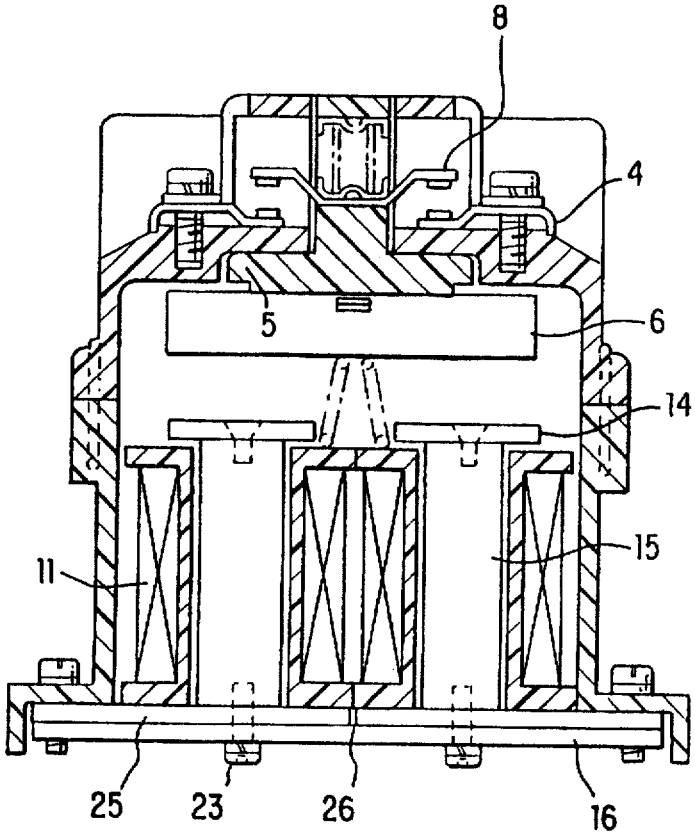
FIG. 3 is a sectional view showing the whole structure of an electromagnet device of a second embodiment of the present invention.
Figure 4:
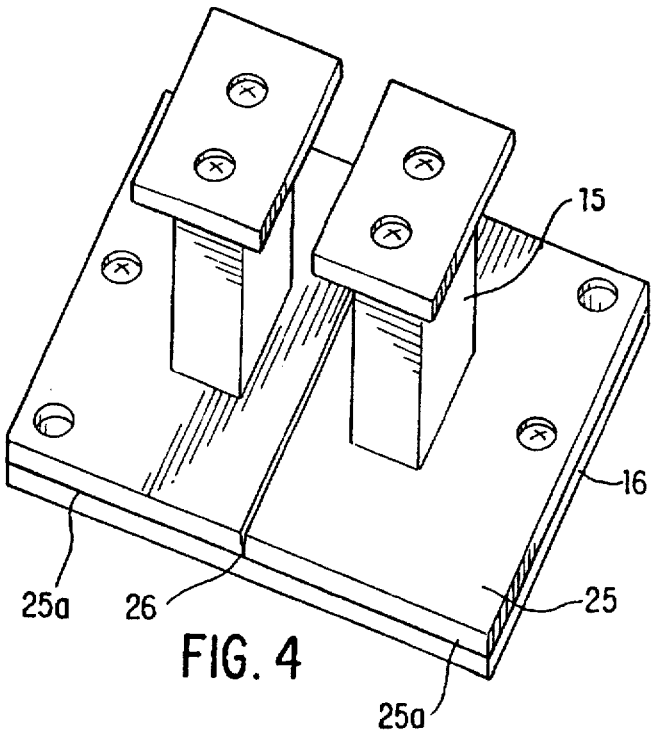
FIG. 4 is a perspective view showing a main structure of a stationary core shown in FIG. 3.

FIG. 3 is a sectional view showing the whole structure of an electromagnet device of a second embodiment of the present invention, and FIG. 4 shows a perspective view of a stationary core shown in FIG. 3.

In this embodiment, a base plate 16 is made of a non-magnetic stainless steel plate, and a ferromagnetic plate 25 is inserted between the base plate 16 and the arm cores 15. The ferromagnetic plate 25 is divided into two ferromagnetic plates **25*a* at the center between the arm cores 15 to interrupt the magnetic path thereat. As to a concrete method for magnetic path interruption, two ferromagnetic plates 25*a* are fixed to the arm cores 15 together with the base plate by using screws 23 so as to form a gap 26 between the ferromagnetic plates 25*a*. Alternatively, after plating or coating on at least one of the ferromagnetic plates 25*a*, two ferromagnetic plates 25*a* are contacted together and are fixed to the arm cores 15 together with the base plate by using the screws 23**.

The electromagnet device for the electromagnetic contactor according to the invention, which has the structure described above, shows the following effects.

In the structure of the electromagnet device according to the present invention, since the stationary core of the electromagnet device has the means for interrupting a part of a magnetic path, a remanent flux in the cores of the electromagnet after de-energizing of the coils is reduced by the interrupting means. Therefore, it becomes unnecessary to joint a non-magnetic plate to the pole surface, so that the movable core can directly collide with the pole pieces, and the pole pieces can be freely made thick. As a result, in the electromagnet device, deformation or damage on the pole face does not occur.

In one aspect of the invention, a ferromagnetic plate is used as the base plate to constitute the stationary core, and the interrupting means are located between the arm cores and the pole pieces and/or between the arm cores and the base plate.

In another aspect of the invention, a stationary core comprises a non-magnetic plate used as the base plate and a ferromagnetic plate inserted between the base plate and the arm cores, and the interrupting means are located between the arm cores and the pole pieces, between the arm cores and the ferromagnetic plate, and/or in the ferromagnetic plate. Since the interrupting means are located at the respective ends of each constituent member for the stationary core, the interrupting means can be disposed at a low cost without processing the constituent member.

In a further aspect of the invention, since the interrupting means is formed of the non-magnetic coating layer or plating layer on the surface of each structural member of the stationary core, the interruption of the magnetic path can be made at a low cost.

In a still further aspect of the invention, in case a ferromagnetic plate is inserted between the non-magnetic base plate and the ferromagnetic arm cores to constitute the stationary core having the magnetic path interrupted in the ferromagnetic plate, the ferromagnetic plate is divided into two sections with a gap therebetween at the interrupting position, so that the magnetic path is interrupted at the gap. Therefore, interruption can be made at a further lower cost without coating or plating onto the structural members.

What is claimed is:

1. An electromagnet device for an electromagnetic contactor, comprising:

a frame having an opening;

a movable-contact supporter slidably disposed in the frame;

a movable contact supported by the movable-contact supporter;

a movable core connected to the movable-contact supporter;

a stationary core for attracting said movable core and having a magnetic path therein, said stationary core including a base plate formed of a magnetic material and closing the opening of the frame, at least one columnar arm core fixed to and disposed on the base plate to extend therefrom, and at least one pole piece fixed to the arm core at a side opposite to the base plate, said pole piece exerting attracting force to said movable core; and means for partly interrupting the magnetic path of said stationary core located in at least one of first and second positions, said first position being located between said arm core and said pole piece and said second position being located between said arm core and said base plate, said interrupting means reducing remanent flux in the stationary core when the stationary core is deenergized.

2. An electromagnet device as claimed in claim 1, wherein said base plate is formed of a ferromagnetic material, said means for partly interrupting the magnetic path being located in at least one of first and second positions, said first position being located between said arm core and said pole piece and said second position being located between said arm core and said base plate.

3. An electromagnet device as claimed in claim 1, further comprising a ferromagnetic plate inserted between said arm core and said base plate, said base plate being formed of a non-magnetic material and said interrupting means being located in at least one of first, second and third positions, said first position being located between said arm core and said pole piece, said second position being located between said arm core and said ferromagnetic base plate, said third position being located in said ferromagnetic base plate.

4. An electromagnet device as claimed in claim 1, wherein said interrupting means is formed of one of a coated layer made of a non-magnetic material and a plated layer made of a non-magnetic material.

5. An electromagnet device for an electromagnetic contactor, comprising:

a frame having an opening;

a movable-contact supporter slidably disposed in the frame;

a movable contact supported by the movable-contact supporter;

a movable core connected to the movable-contact supporter;

a stationary core for attracting said movable core and having a magnetic path therein, said stationary core including a base plate formed of a non-magnetic material and closing the opening of the frame, at least one columnar arm core fixed to and disposed on the base plate to extend therefrom, and at least one pole piece fixed to the arm core at a side opposite to the base plate, said pole piece exerting attracting force to said movable core;

a magnetic plate inserted between said arm core and said base plate; and means for partly interrupting the magnetic path of said stationary core located in at least one of first, second and third positions, said first position being located between said arm core and said pole piece, said second position being located between said arm core and said magnetic plate, said third position being located in said magnetic plate, said interrupting means reducing remanent flux in the stationary core when the stationary core is deenergized.

6. An electromagnet device as claimed in claim 5, wherein said means for interrupting the magnetic path of the stationary core is a gap formed in the magnetic plate.

7. An electromagnet device as claimed in claim 6, wherein the magnetic plate is formed of two halved magnetic plates, said gap being formed between the halved magnetic plates, one of said columnar arms being fixed to each of the halved magnetic plate.

8. An electromagnet device as claimed in claim 4, wherein one of the non-magnetic coating layer and the plated layer is disposed on a surface of at least one of the base plate, the arm core and the pole piece.

9. An electromagnet device as claimed in claim 1, wherein said stationary core is formed of said base plate, two of said at least one columnar arm core disposed on the base plate, and two of said at least one pole piece, each pole piece being fixed to each columnar arm, said interrupting means interrupting the magnetic path in said stationary core.

* * * * *